US009285198B2

(12) United States Patent
Nelson et al.

(10) Patent No.: US 9,285,198 B2
(45) Date of Patent: Mar. 15, 2016

(54) ARM-FIRE DEVICES AND METHODS FOR PYROTECHNIC SYSTEMS

(75) Inventors: Steven D. Nelson, Huntington Beach, CA (US); Robert S. Ritchie, Newhall, CA (US)

(73) Assignee: Pacific Scientific Energetic Materials Company, Valencia, CA (US)

( * ) Notice: Subject to any disclaimer, the term of this patent is extended or adjusted under 35 U.S.C. 154(b) by 405 days.

(21) Appl. No.: 12/370,582

(22) Filed: Feb. 12, 2009

(65) Prior Publication Data

US 2009/0314174 A1 Dec. 24, 2009

Related U.S. Application Data

(60) Provisional application No. 61/028,160, filed on Feb. 12, 2008.

(51) Int. Cl.
*F42C 15/34* (2006.01)
*F42C 15/184* (2006.01)

(52) U.S. Cl.
CPC ..... *F42C 15/34* (2013.01)

(58) Field of Classification Search
CPC ..... F42C 15/00; F42C 15/005; F42C 15/18; F42C 15/184; F42C 15/188; F42C 15/34; F42C 15/36
USPC ..... 102/222, 254, 255, 256
See application file for complete search history.

(56) References Cited

U.S. PATENT DOCUMENTS 2,767,655 A * 10/1956 Seavey ..... 102/275.9
2,919,648 A * 1/1960 Jordan ..... 102/245
3,015,275 A * 1/1962 Peyton et al. ..... 102/254
3,580,128 A 5/1971 Leich
3,580,177 A * 5/1971 Krahulec ..... 102/244
3,618,522 A * 11/1971 Henderson ..... 102/222
3,620,163 A * 11/1971 Shekro ..... 2/251
3,760,726 A * 9/1973 Overman ..... 102/222
3,822,413 A * 7/1974 Flanagan ..... 337/127
3,853,056 A * 12/1974 Fisher ..... 102/420

(Continued)

OTHER PUBLICATIONS

International Search Report and Written Opinion; International Patent Application No. PCT/US09/33976; Filed: Feb. 12, 2009; Applicant: Pacific Scientific Energetic Materials Company; Mailed on Oct. 13, 2009.

*Primary Examiner* — Bret Hayes
*Assistant Examiner* — Derrick Morgan
(74) *Attorney, Agent, or Firm* — Perkins Coie LLP

(57) ABSTRACT

An ARM-FIRE device for a pyrotechnic system includes a first pyrotechnic, a second pyrotechnic, a passage extending between the first and second pyrotechnics, and an actuator/blocking device positioned between the first and second pyrotechnics. The first pyrotechnic is configured to be ignited by a heat source, and the second pyrotechnic is configured to be ignited by the first pyrotechnic in the FIRE arrangement. The actuator/blocking device includes a body configured to move between a first position in the SAFE arrangement and a second position in the FIRE arrangement, an aperture extending through the body, and an actuator. The aperture is offset from the passage in the first position of the body and is aligned with the passage in the second position of the body. The actuator is configured to move the body between the first and second positions. The first pyrotechnic, the second pyrotechnic, and the actuator/blocking device occupy a volume of approximately 49 cubic cm (3.0 cubic inches)or less.

19 Claims, 7 Drawing Sheets

(56) References Cited

U.S. PATENT DOCUMENTS

| | | | | |
|---|---|---|---|---|
| 3,858,516 | A * | 1/1975 | Rabinow | 102/216 |
| 3,985,079 | A * | 10/1976 | Post et al. | 102/235 |
| 5,693,906 | A * | 12/1997 | Van Sloun | 102/251 |
| 5,705,767 | A * | 1/1998 | Robinson | 102/231 |
| 6,167,809 | B1 | 1/2001 | Robinson et al. | |
| 6,173,650 | B1 * | 1/2001 | Garvick et al. | 102/202.5 |
| 6,431,071 | B1 * | 8/2002 | Hodge et al. | 102/254 |
| 7,051,656 | B1 * | 5/2006 | Koehler et al. | 102/249 |
| 7,134,445 | B2 | 11/2006 | Broyer et al. | |
| 7,258,068 | B2 * | 8/2007 | Worthington | 102/256 |
| 7,383,774 | B1 * | 6/2008 | Koehler et al. | 102/249 |
| 7,444,937 | B2 * | 11/2008 | Magnan et al. | 102/254 |
| 7,490,553 | B2 * | 2/2009 | Magnan et al. | 102/254 |
| 7,530,312 | B1 * | 5/2009 | Roesler et al. | 102/249 |
| 7,712,419 | B1 * | 5/2010 | Cheng et al. | 102/487 |
| 7,895,947 | B1 * | 3/2011 | Sutherland et al. | 102/254 |
| 8,191,477 | B1 * | 6/2012 | Roesler | 102/254 |
| 2005/0081732 | A1 * | 4/2005 | Worthington | 102/229 |
| 2006/0254448 | A1 * | 11/2006 | Alculumbre et al. | 102/244 |
| 2008/0134922 | A1 * | 6/2008 | Grattan et al. | 102/206 |

* cited by examiner

ARM-FIRE DEVICES AND METHODS FOR PYROTECHNIC SYSTEMS

CROSS-REFERENCE TO RELATED APPLICATION(S)

This patent application claims the benefit under 35 U.S.C. §119 of U.S. Provisional Patent Application No. 61/028,160, filed on Feb. 12, 2008, entitled "Micro Safe and Arm Device," which is incorporated herein in its entirety by reference.

TECHNICAL FIELD

The present disclosure relates generally to ARM-FIRE devices (AFDs), and more particularly, to micro-sized AFDs that include an interrupter for preventing inadvertent ignition of rocket motors or other pyrotechnic systems, and methods for preventing inadvertent ignition of pyrotechnic devices.

BACKGROUND

Government safety regulations specify various parameters and requirements for military pyrotechnic systems such as rocket motors and missile fuzes. For example, MIL-STD-1901A requires that propulsion ignition systems utilize energy train and pyrotechnic train interruption devices, also known as "out-of-line devices."

Known AFDs include a physical barrier to interrupt an ignition train between an igniter device and a target pyrotechnic in the event that the igniter device is accidentally triggered. Accordingly, the interrupter provides absolute no-fire in a SAFE arrangement and extreme all-fire in a FIRE arrangement. In addition, if an ARM command power is removed, the interrupter returns to the SAFE arrangement without power assist.

Conventional AFDs are generally controlled by a combination of electrical and mechanical components. Such AFDs may include switches, motors, and other elements for removing a physical barrier, e.g., to arm a rocket motor or another pyrotechnic system, and for replacing the physical barrier to disarm the rocket motor or other pyrotechnic system. FIG. 13A shows an example of such a conventional AFD, which may be too bulky, heavy, or costly, and/or otherwise require too much power to be included in some weapons systems. As a result, conventional AFDs are not utilized in miniature munitions.

Another type of safety device is a safe and arm (S&A) mechanism. As shown in FIG. 13B, an S&A mechanism may be smaller than a conventional AFD, such as that shown in FIG. 13A. There remains, however, a need for a micro-size AFD that can be made smaller than either known conventional AFD or S&A mechanisms.

BRIEF SUMMARY OF THE INVENTION

Aspects of the present invention are generally directed toward an ARM-FIRE device for a pyrotechnic system. One aspect of embodiments is directed toward a device including a first pyrotechnic, a second pyrotechnic, a passage extending between the first and second pyrotechnics, and an actuator/blocking device positioned between the first and second pyrotechnics. The first pyrotechnic is configured to be ignited by a heat source, and the second pyrotechnic is configured to be ignited by the first pyrotechnic in the FIRE arrangement. The actuator/blocking device includes a body configured to move between a first position in the SAFE arrangement and a second position in the FIRE arrangement, an aperture extending through the body, and an actuator. The aperture is offset from the passage in the first position of the body and is aligned with the passage in the second position of the body. The actuator is configured to move the body between the first and second positions. The first pyrotechnic, the second pyrotechnic, and the actuator/blocking device occupy a volume of approximately 49 cubic cm 3.0 (cubic inches) or less.

Other aspects of the present invention are generally directed to an ARM-FIRE device for a pyrotechnic system. One aspect of embodiments includes a first pyrotechnic, a second pyrotechnic configured to be ignited by the first pyrotechnic in a FIRE arrangement, a passage extending between the first and second pyrotechnics, and an actuator/blocking device including first and second holes. The first hole is aligned with the passage, and the second hole is configured to move between a first position offset from the passage and a second position aligned with the passage. The passage, the first hole and the second hole are aligned in the FIRE arrangement, and a SAFE arrangement includes the second hole in the second position.

Yet other aspects of the present invention are generally directed toward a pyrotechnic system having a FIRE arrangement and a SAFE arrangement. One aspect of embodiments includes a pyrotechnic charge and an initiator configured to ignite the pyrotechnic charge in the FIRE arrangement and to prevent igniting the pyrotechnic charge in the SAFE arrangement. The initiator includes a first pyrotechnic, a second pyrotechnic, and an actuator/blocking device configured to isolate the first and second pyrotechnics in the SAFE arrangement. The second pyrotechnic is configured to be ignited by the first pyrotechnic and to ignite the pyrotechnic charge in the FIRE arrangement. The actuator/blocking device includes a shaped metal alloy wire actuator that is configured to expose the second pyrotechnic to the first pyrotechnic in the FIRE arrangement.

Still other aspects of the present invention are generally directed toward a method of making an ARM-FIRE device for preventing an inadvertent ignition of a pyrotechnic system. One aspect of embodiments is directed toward a method including aligning a first pyrotechnic at a first end of a passage, aligning a second pyrotechnic at a second end of the passage, fabricating an actuator/blocking device with LIGA technology, and positioning the actuator/blocking device to occlude the passage.

DETAILED DESCRIPTION

A. Overview

Embodiments according to the present disclosure include various AFDs that prevent inadvertent ignition of rocket motors or other pyrotechnic systems. Other embodiments according to the present disclosure further include various methods for preventing inadvertent ignition of rocket motors or other pyrotechnic systems. Certain embodiments are designed to comply with government safety regulations such as MIL-STD-1901A.

Embodiments according to the present disclosure include AFDs suitable for pyrotechnically actuated weapons systems where conventional AFDs are not readily implemented. For instance, certain embodiments include an AFD that is contained within a small package, e.g., having a diameter of less than approximately 1.9 cm (0.75 inches) and an axial length of less than approximately 5 cm (2.0 inches), or a diameter of approximately 1.3 cm (0.5 inches) and an axial length of approximately 3.8 cm (1.50 inches).

Figure 13C:
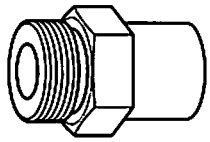
FIGS. 13A-13C show the relative sizes of a conventional AFD, an S&A mechanism, and a micro AFD in accordance with an embodiment of the present disclosure.
Figure 13B:
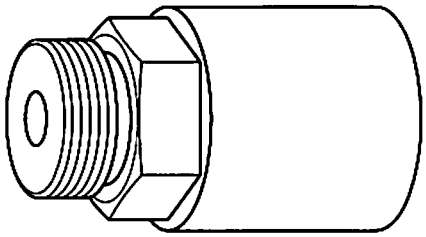
Figure 13A:
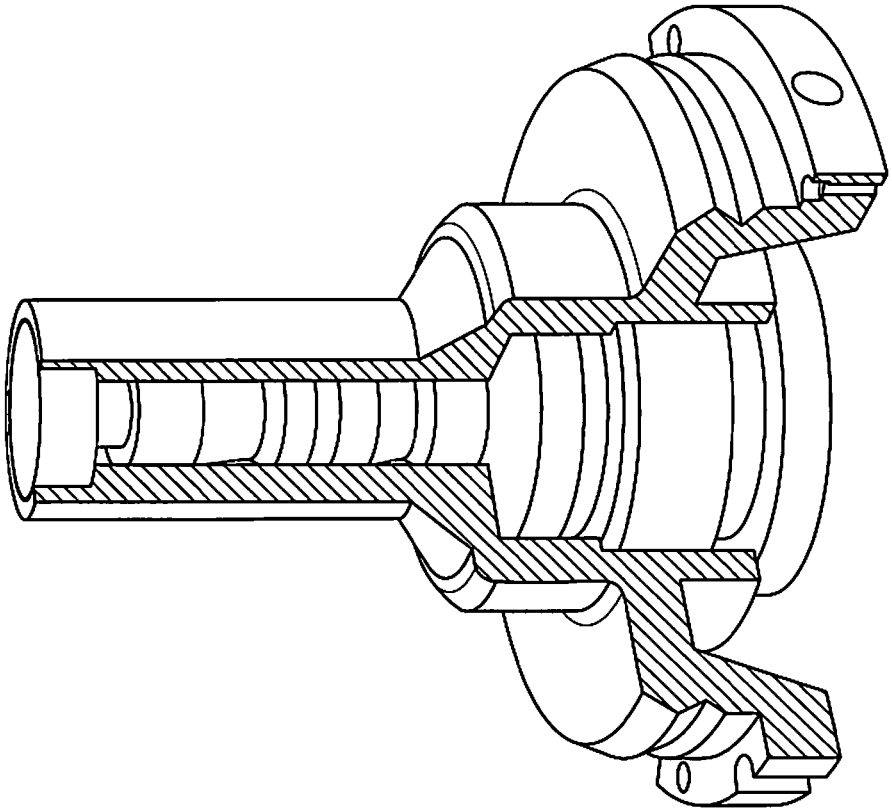

Embodiments according to the present disclosure include AFDs suitable for an integrated initiator and SAFE and FIRE package. This enables the SAFE and ARM functions to be available in systems that use a standard initiator. In particular, as will be described below, by utilizing certain micro-sized manufacturing techniques, such as LIGA technology, and/or materials, such as shape memory alloys, a micro AFD occupies a volume of approximately 49 cubic cm (3.0 cubic inches) or less, and approximately 24.5 cubic cm (1.5 inches) or less, which constitutes a significantly reduced size as compared to conventional safe and arm devices (see, e.g., FIG. 13A versus FIG. 13C).

Embodiments according to the present disclosure are suitable for application in a variety of military and aerospace technologies such as rocket engines and other pyrotechnic devices. Moreover, certain features of embodiments according to the present disclosure are suitable for application in S&A mechanisms, ignition safety devices (ISD), fuzes, smart systems, and initiators, as well as AFDs.

As will be described, in accordance with an embodiment of this disclosure, the AFDs are designed to have very high strength and tolerances to withstand various environmental inputs. In particular, the AFDs can have high mechanical strength and toughness so as to withstand large shocks or vibration loads. Additionally, the AFDs can be devised so as to withstand large temperature extremes.

B. Embodiments of ARM-FIRE Devices and Methods for Using Such Devices

Figure 1B:
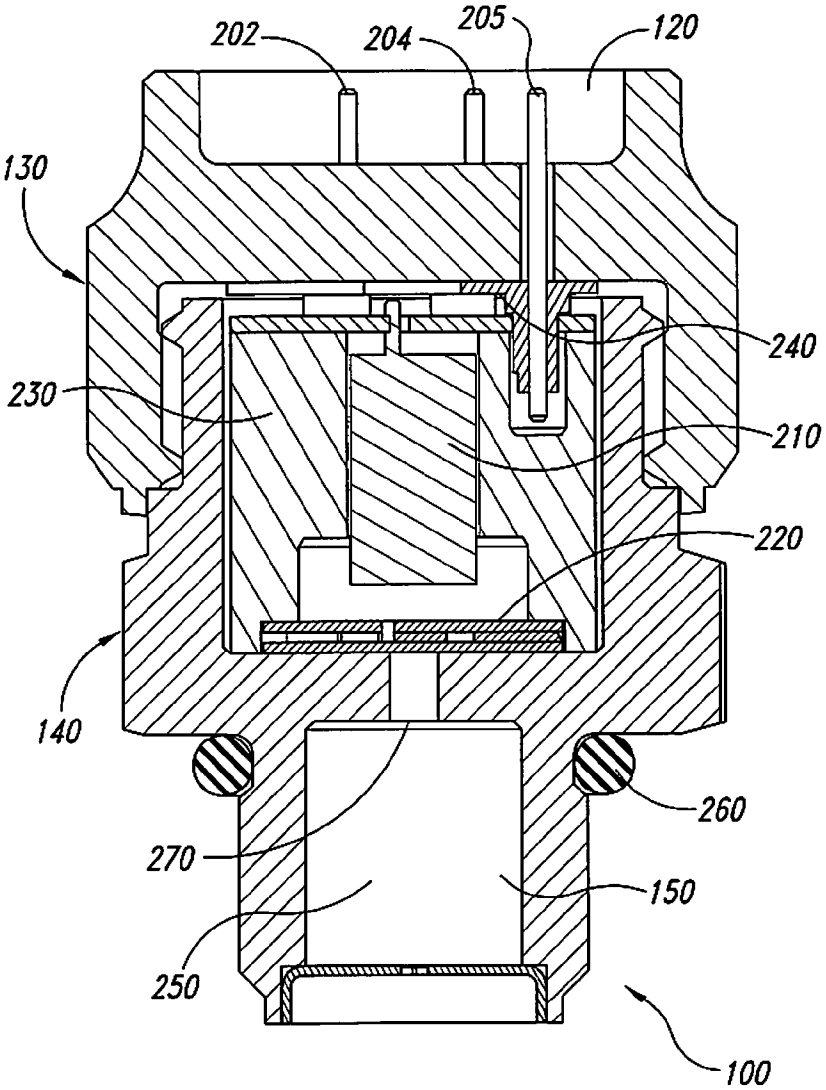
FIG. 1B is a cross-section view showing the micro AFD shown in FIG. 1A.
Figure 1A:
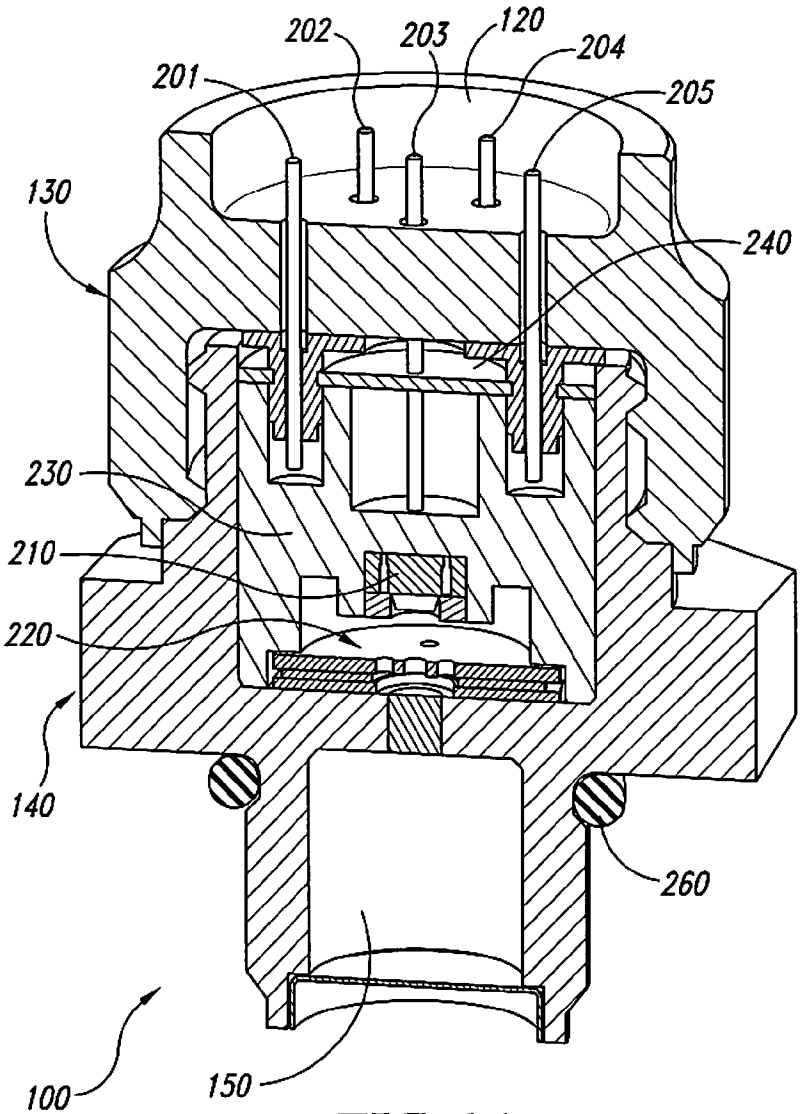
FIG. 1A is cross-section perspective view showing a micro AFD in accordance with an embodiment of the present disclosure.

FIGS. 1A and 1B show a micro AFD 100 in accordance with an embodiment of the present disclosure. The micro AFD 100 includes a back shell 130 which contains the electrical connector pins to leads, and provides a seal for the electronics. At the top of the back shell, there is a connector 120 to electrical inputs/outputs.

The micro AFD 100 additionally includes a body 140 which houses the electronics, the actuator mechanism, and the secondary pyrotechnics for the device. At a lower part of the body, there exists a cavity 150, which provides a pyrotechnic output to a rocket motor or other pyrotechnic system to be initiated.

A number of pin connectors 201, 202, 203, 204, and 205 provide electrical connectivity to the micro AFD 100. In particular, in some embodiments, two pin connectors are utilized for providing a voltage differential for actuating the micro AFD 100, another two pin connectors are utilized for probing the micro AFD 100 for determining status to indicate the SAFE or ARM arrangements of the micro AFD 100, and still another two pin connectors can be used for igniting the primary pyrotechnic, as will be described below.

A retainer 230 holds an initiator 210. Additionally, an actuator/blocking device 220 (as will be described below in greater detail), and a circuit card 240 that interfaces with the pin connectors described above are included inside the back shell 130 and the body 140. In particular, the circuit card 240 includes a separate receptacle for receiving each pin. Retainer 230 may be made of polyethylene, but alternatively could be made of other materials.

Below the actuator/blocking device 220 in FIG. 2 is a pyro package 250 placed in a charge cavity machined within the lower portion of the body 140. The cavity may be designed for holding mil-Standard-approved pyrotechnics.

A membrane 270 is located between the pyro package 250 and the actuator/blocking device 220. The membrane 270 is configured to separate the pyrotechnic material from the actuator/blocking device 220.

Beneath the body 140 and around the cavity containing the pyro package 250 is an O-ring 260. The O-ring seals the micro AFD 100 to prevent leakage out to the larger unit to be ignited (e.g., the rocket motor).

Figure 2A:
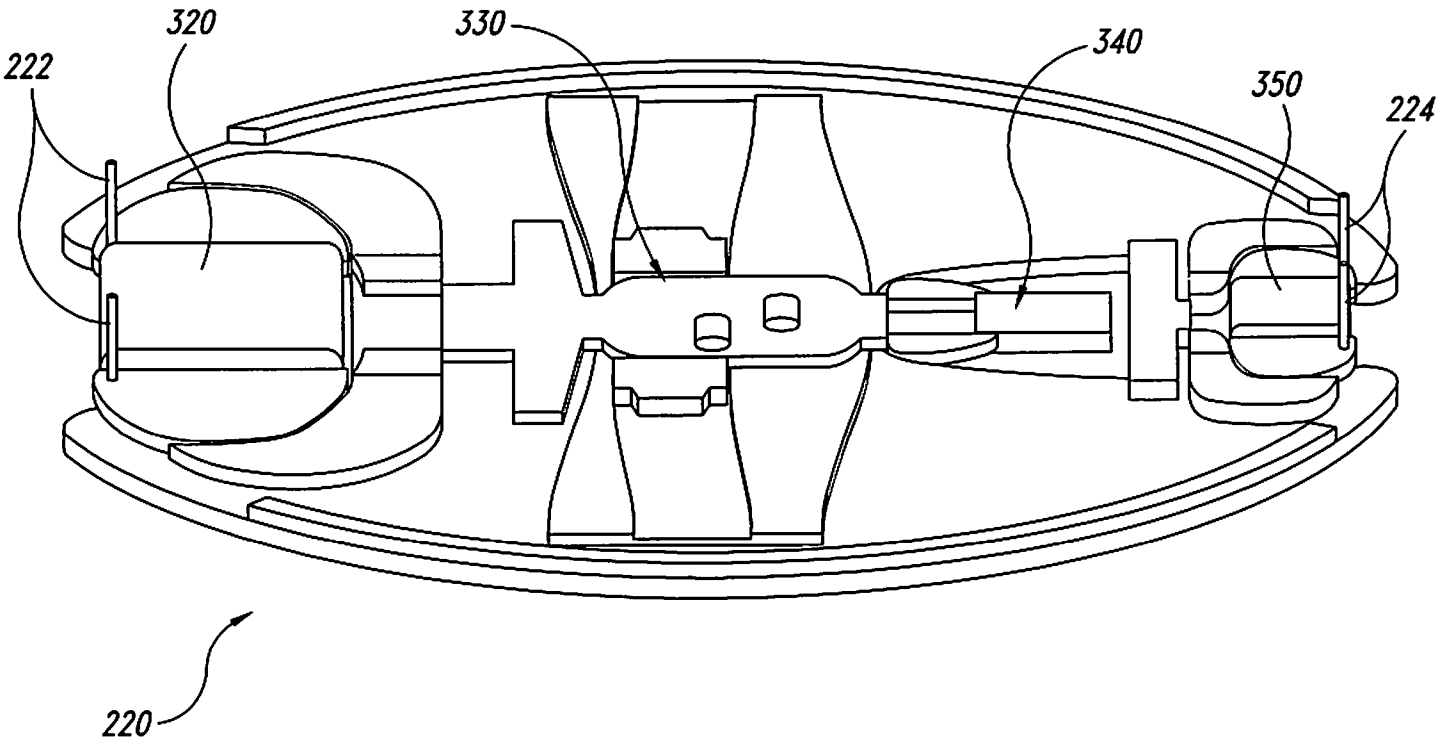
FIG. 2A is a perspective view showing an actuator/blocking device for a micro AFD in accordance with an embodiment of the present disclosure.
Figure 2B:
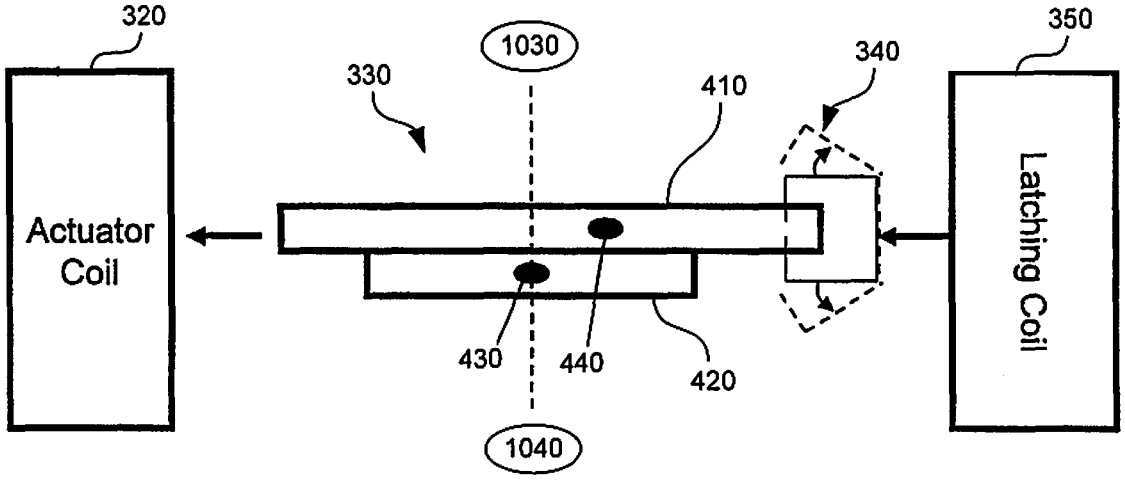
FIG. 2B schematically illustrates an operation of the actuator/blocking device shown in FIG. 2A.

FIGS. 2A and 2B show an actuator/blocking device 220 and its operation within a micro AFD 100 in accordance with an embodiment of the present disclosure. The actuator/blocking device 220 shown FIG. 2 includes electrical leads 222 connect to an actuator coil 320, which in turn actuates a shutter mechanism 330 that slides with respect to a base 300. A latching coil 350 is connected to a latching mechanism 340 for latching the shutter mechanism 330.

In some embodiments, the actuator/blocking device 220 can be machined using LIGA technology. LIGA is an acronym (Lithographie—lithography, Gaivanoformung—electroplating, Abformung—molding) for a process by which extremely small components can be manufactured by etching and re-depositing. Other techniques can be utilized instead of LIGA processing, depending upon the environment in which the micro AFD 100 is intended to be utilized. For example, features of the actuator/blocking device 220 can also be manufactured utilizing metal injection molding (MIMs), sintering, advanced molding techniques, or other suitable manufacturing and/or assembly techniques.

In some embodiments, the actuator/blocking device 220 can be made of metal. However, other materials can be used with or instead of metal. For example, certain ceramic materials can be utilized as long as the micro-machining can be accomplished to provide an actuator/blocking device 220 that can survive the shock of pyro-firing.

FIG. 2B schematically illustrates the operation of the actuator/blocking device 220 shown in FIG. 2*a*. The latching mechanism 340 holds a slider 410 in place to maintain the shutter mechanism 330 in a SAFE arrangement while the micro AFD 100 is unarmed. By holding the slider 410 in the SAFE arrangement when the micro AFD 100 is unarmed, the latching mechanism 340 prevents the slider 410 from moving in response to extreme vibrations or shock.

Upon application of electrical signals to the latching coil 350, the latching coil 350 controls the latching mechanism 340 to release the slider 410. The release of the slider 410 by the latching mechanism 240 is indicated in FIG. 2B by dotted lines and the accompanying arrows.

Once the latching mechanism 340 releases the slider 410, a force provided by the actuator coil 320 causes the slider 410 to move relative to a stationary shutter component 420. This movement aligns at least two holes 430 and 440 of slider 410 and the stationary shutter component 420 along a vertical dotted line shown in FIG. 2B. Accordingly, the alignment of the holes 430 and 440 allows the transfer of ignition products from a primary pyrotechnic charge above the shutter mechanism 330 to ignite a secondary pyrotechnic charge below the shutter mechanism 330, when the micro AFD 100 is in the FIRE arrangement.

In some embodiments, the actuator coil 320 is an electromagnetic coil that converts electrical signals into mechanical motion. The actuator coil 320 thus acts as a transducer to provide a mechanical force that moves the slider 410 from a SAFE arrangement to a FIRE arrangement with respect to the stationary shutter component 420. In other embodiments, the actuator can include a piezo-electric actuator or another device suitable for rotating, shifting or otherwise moving the slider 410.

The shutter mechanism 330 acts as a movable device to selectively block the flow of ignited pyrotechnics, and has at least two modes of operation—interrupting and access. The shutter mechanism includes 330 maintains the holes 430 and 440 out of alignment in the SAFE arrangements. The holes 430 and 440 are used for allowing the transfer of combustion or detonation products from the primary pyrotechnic charge to ignite the secondary pyrotechnic charge in the FIRE arrangement. Thus, the device micro AFD 100 receives an ARM command, the shutter mechanism 330 slides to align the holes 430 and 440, thereby enabling this transfer. At this stage, the micro AFD 100 is in the FIRE arrangement.

Additionally, the shutter mechanism 330 provides the required degree of motion while still having the requisite "toughness" for the application in which the micro AFD 100 is designed. Other shutter mechanisms can be utilized that can be appropriately sized, have the requisite strength, and function to selectively prevent an inadvertent blast from entering a secondary pyrotechnic area. As an alternative to a shutter mechanism, a diverter could be utilized instead.

In certain embodiments, the shutter mechanism 330 is configured to be repeatedly armed and disarmed. The micro AFD 100 remains armed as long as power is applied to the leads 222 and 224. If voltage is removed from the leads 222 and 224 prior to ignition, springs that are associated with the shutter mechanism 330 pull back the slider 410 within the shutter mechanism 330 to once again move the hole 430 in the slider 410 out of alignment with the hole 440, thereby configuring the micro AFD 100 in the SAFE arrangement. In this process, the same spring that pulls the slider 410 back re-latches the shutter mechanism 330 to maintain the micro AFD 100 in the SAFE arrangement.

In still other embodiments, the shutter mechanism 330 can include a status mechanism that enables a user to discern whether the micro AFD 100 is in SAFE or FIRE arrangement. Two additional leads are placed in electrical communication with the shutter mechanism 330 to detect positioning of the slider 410 within the shutter mechanism 330.

The latching mechanism 340 holds the slider 410 of the shutter mechanism 330 in the SAFE arrangement of the micro AFD 100. In certain embodiments, the latching mechanism 340 includes at least one prong to physically latch or engage the slider 410 to prevent movement due to environmental inputs, such as during extreme vibration or shock. When the latching coil 350 is energized, it controls the latching mechanism 340 to release the shutter mechanism 330, allowing the actuator coil 320 to move the shutter mechanism 330 into the FIRE arrangement. The latching coil 350 can be implemented using an electrical magnet, or alternatively, a bi-stable linear actuator, such as a transverse locking mechanism.

The membrane 270 can include any of several different membrane types that are suitable for separating pyrotechnic material from the actuator/blocking device 220 in the SAFE arrangement. In general, the membrane 270 should be sufficiently strong and impermeable to prevent the pyrotechnic material from entering the actuator/blocking device prior to ignition of the material. Additionally, the membrane should maintain integrity over a regular operating temperature ranges of the micro AFD 100. However, the membrane 270 should also be quickly frangible and/or combustible to allow efficient ignition of the pyrotechnic material. Example membrane types having some or all of these properties include sheets of nitrocellulose.

Figure 3A:
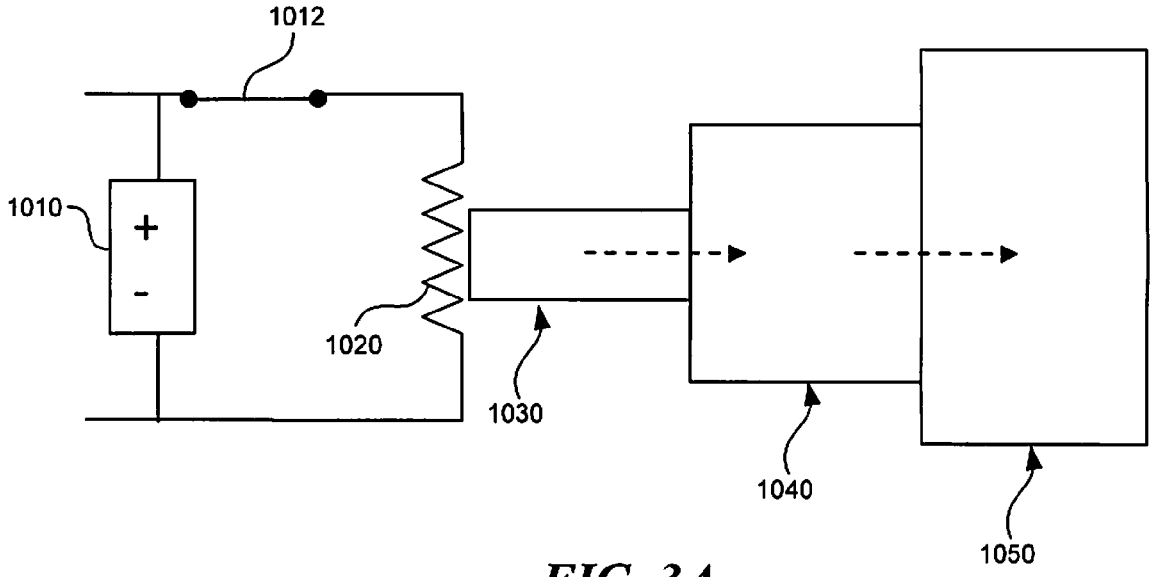
FIGS. 3A and 3B schematically illustrate the FIRE and SAFE operations of an AFD in accordance with an embodiment of the present disclosure.

FIGS. 3A and 3 B schematically illustrate the general operation of the AFD 100. A power source 1010 supplies current to a resistive heating element 1020 that ignites a first pyrotechnic 1030 in the micro AFD 100. The power source 1010 can be a battery or another suitable device capable of supplying an operating voltage in the range of 5-72 volts direct current (VDC), and approximately 24-48 VDC, and approximately 28 VDC. The voltage is applied across the leads 222 to energize an actuator coil 320 and the leads 224 to energize the latching coil 350. In comparison with the actuator coil 320, the latching coil 350 can have lower overall inductance and will become energized first to actuate the latching mechanism 340. Once the actuator coil 320 is energized, it then draws open a shutter mechanism 330. The power source 1010 supplies the operating voltage to the resistive heating element 1020 in response to an ARM command, e.g., closing a switch 1012. In the FIRE arrangement shown in FIG. 3A, the resistive element 1020 is heated by applying power (e.g., 28 VDC) to a second set of leads. This causes the first pyrotechnic 1030 to auto-ignite, generating combustion products that are transferred to a second pyrotechnic 1040 via the aligned holes 430 and 440. The second pyrotechnic 1040 may be is less sensitive to ignition than the first pyrotechnic 1030 such that the resistive heating element 1020 may not be able to directly ignite the second pyrotechnic 1040. The second pyrotechnic 1040 then ignites the third pyrotechnic 1050, which may be, e.g., a rocket motor or propellant. In general, the third pyrotechnic 1050 is the least sensitive to ignition of the three pyrotechnics 1030, 1040 and 1050 such that neither the resistive heating element 1020 nor the first pyrotechnic 1030 may be able to directly ignite the third pyrotechnic 1050.

Figure 3B:
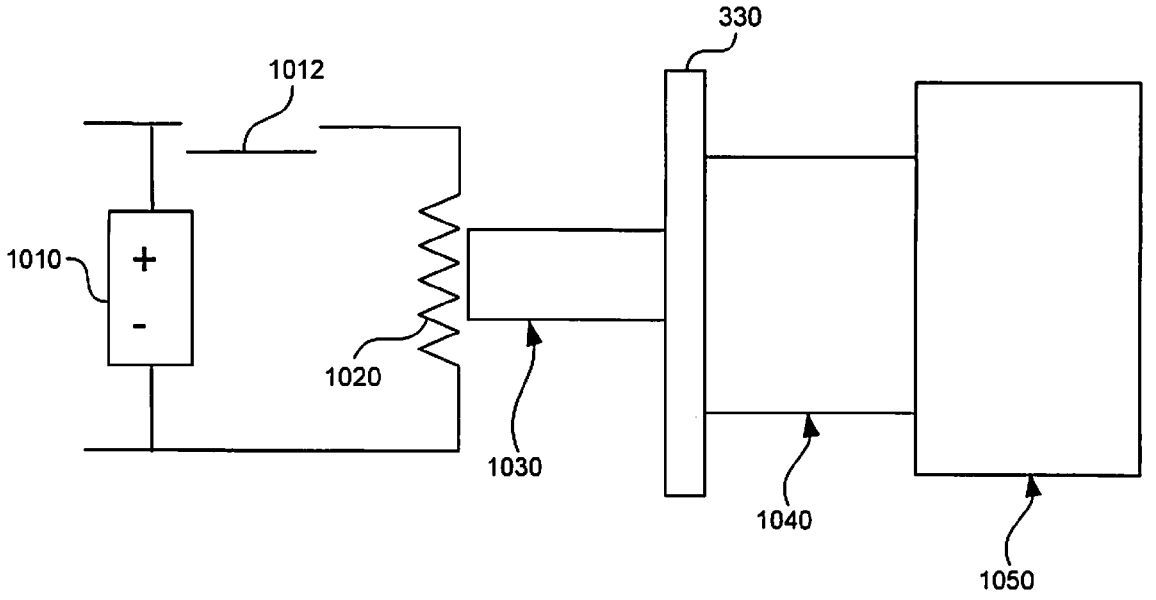

In the SAFE arrangement shown in FIG. 3B, the shutter mechanism 330 of the actuator/blocking device 220 interrupts the ignition train between the first pyrotechnic 1030 and the secondary pyrotechnic 1040. In particular, slider 410 of the actuator/blocking device 220 can occlude or otherwise block the 440 of the stationary shutter component 420, and thereby prevent passage of the ignited components of the first pyrotechnic 1030 through to ignite the secondary pyrotechnic 1040. Accordingly, the actuator/blocking device 220 prevents an inadvertent ignition of the first pyrotechnic 1030 from igniting the secondary pyrotechnic 1040, much less igniting the third pyrotechnic 1050.

If the micro AFD 100 has not received an ARM command, such that the holes 430 and 440 are out of alignment, generation of the combustion or detonation products by the first pyrotechnic 1030 will not result in ignition of the second charge 1040. Specifically, because the holes 430 and 440 are not aligned, the combustion products will not propagate to the second pyrotechnic 1040. Instead, the combustion products remain separated from the second pyrotechnic 1040 by the actuator/blocking device 220.

Figure 4:
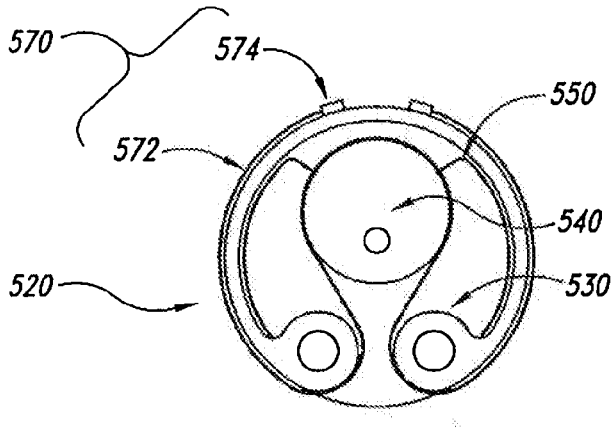
FIG. 4 is a perspective view showing an actuator/blocking device for a micro AFD in accordance with another embodiment of the present disclosure.

FIGS. 4-8 show an actuator/blocking device 520 for a micro AFD 100 in accordance with another embodiment of the present disclosure. In particular, FIG. 4 shows the actuator/blocking device 520 with its cover 522 removed for the sake of explanation. FIGS. 5A-8 show detail views of the various components of the actuator/blocking device 520. The actuator/blocking device 520 includes a base 530, a sled 540, a return spring 550, and an actuator 570.

Referring additionally to FIGS. 5A-6C, the base 530 includes a slot 532 that provides a guide for movement of the sled 540 with respect to the base 530. In particular, a protrusion 542 extends from the back of the sled 540 and is slidably received in the slot 532 of the base 530. The sled 540 also includes a hole 544 that remains aligned with the slot 532 as the sled 540 moves on the base 530.

Figure 5A:
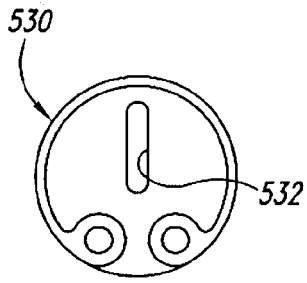
FIGS. 5A and 5B are plan and front views showing a base for the actuator/blocking device shown in FIG. 4.
Figure 5B:
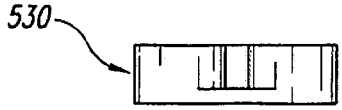

The return spring 550 biases the sled 540 toward the SAFE arrangement of the micro AFT 100, e.g., upward in FIG. 3. Referring to FIGS. 3, 5B and 6, a central portion of the return spring 550 can engage a gap 546 in the protrusion 542 and the ends of the return spring 550 can engage the base 530. The return spring 550 can include a metal leaf spring shaped as shown in FIG. 7. In certain other embodiments, the return spring 550 can include other suitable shapes and materials that bias the sled 540 toward the SAFE arrangement of the micro AFT 100.

Figure 6A:
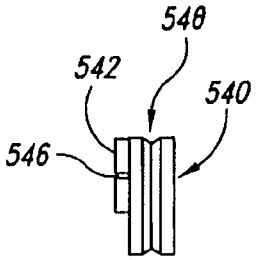
FIGS. 6A-6C are side, back, and top views, respectively, showing a sled for the actuator/blocking device shown in FIG. 4.
Figure 6B:
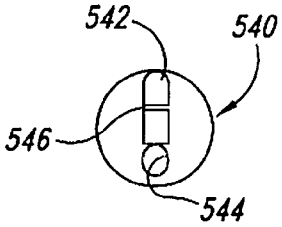
Figure 6C:
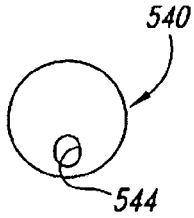
Figure 7:
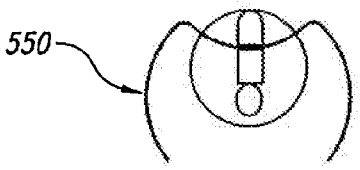
FIG. 7 is a back view showing a return spring as it relates to the sled for the actuator/blocking device shown in FIG. 4.
Figure 8A:
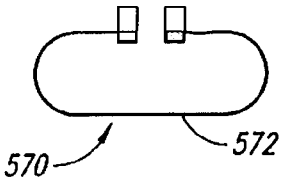
FIGS. 8A and 8B are plan views showing initial and final forms of an actuator for the actuator/blocking device shown in FIG. 4.
Figure 8B:
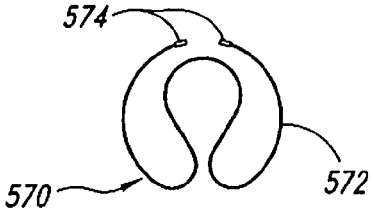
Figure 9:
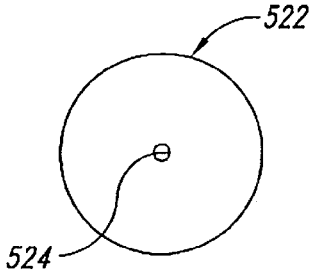
FIG. 9 is a plan view showing a cover for the actuator/blocking device shown in FIG. 3.
Figure 10A:
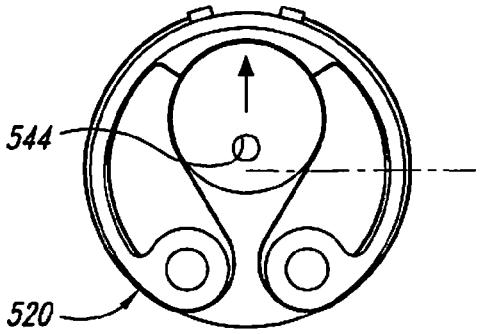
FIGS. 10A and 10B show a SAFE arrangement of the actuator/blocking device shown FIG. 3 and the cover show in FIG. 8.
Figure 10B:
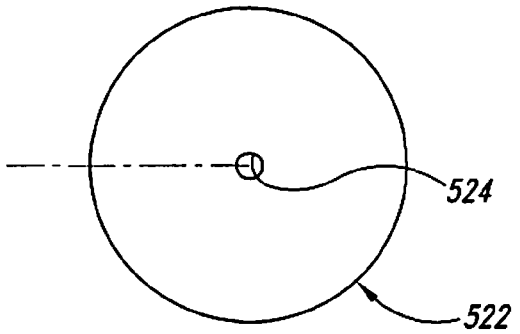
Figure 11A:
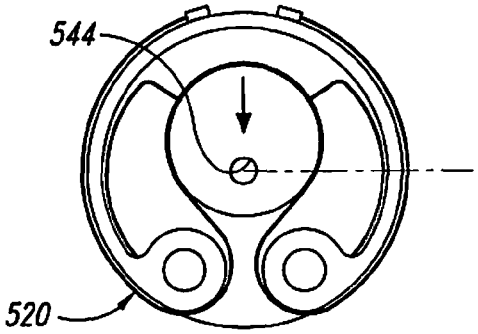
FIGS. 11A and 11B show a FIRE arrangement of the actuator/blocking device shown FIG. 3 and the cover show in FIG. 8.
Figure 11B:
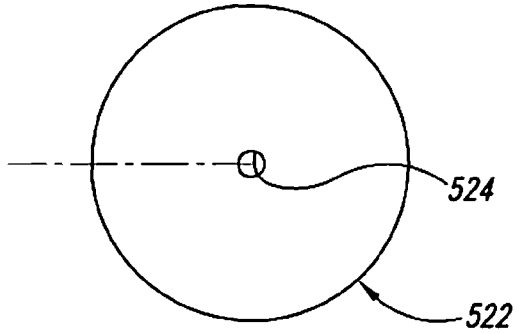

Referring additionally to FIGS. 6A and 6B , the actuator 570 includes a shaped metal alloy (SMA) wire 572 that has electric contacts 574 at both ends of the SMA wire 572. As is well understood, the SMA wire 572 contracts in response to an electric current between the contacts 574. The wire 572 in its initial form is partially looped around the sled 540, e.g., in a groove 548 around the periphery of the sled 540 (FIG. 5A), and then partially wound in opposite directions around the outside of the base 530. The contacts 574 are fixed to the base 530. When an ARM command is sent to the micro AFT 100, an electric current is supplied through the SMA wire 572 via the contacts 574. In response to this electric current, the SMA wire 572 contracts, thereby moving the sled 540 to the FIRE arrangement, e.g., downward in FIG. 3. The movement of the sled 540 is guided by the protrusion 542 sliding in the slot 532. To return to the SAFE arrangement, the electric current is discontinued through the SMA wire 572. This causes the SMA wire 572 to elongate to its original length, and the return spring 550 biases the sled 540 back to the SAFE arrangement.

The cover 522 is secured to the body 520 so as to sandwich the sled 540 between the base 520 and the cover 522. The cover 522 includes a hole 524 that is aligned with the hole 544 of the sled 540 in the FIRE arrangement.

Referring additionally to FIGS. 10A-11B, the operational aspects of the actuator/blocking device 520 will now be explained. For each pair of figures, the cover 522 has been displaced to the right of the base 530. It is to be understood that the cover 522 is secured to the base 530 in the micro AFD 100. In the SAFE arrangement shown in FIGS. 10A and 10B, the hole 544 is offset from the hole 524. Accordingly, there is no line of sight passage by which ignition products from the first pyrotechnic can pass to ignite the second pyrotechnic because the actuator/blocking device 520 is separating the first and second pyrotechnics. In the FIRE arrangement shown in FIGS. 11A and 11B, a line of sight passage through the hole 524 in the cover 522, the hole 544 in the sled 540, and the slot 532 in the base 530 is provided through which ignition products from the first pyrotechnic can pass for igniting the second pyrotechnic.

Figure 12:
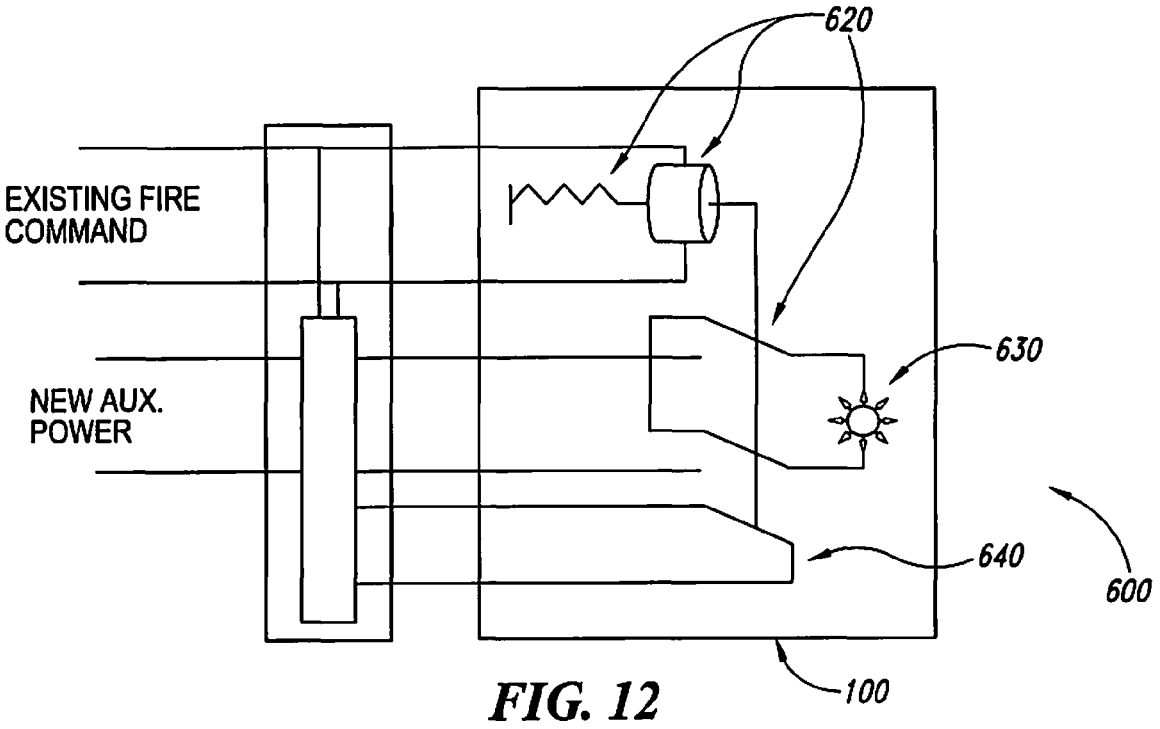
FIG. 12 schematically illustrates a control system for a micro AFD in accordance with an embodiment of the present disclosure.

FIG. 12 schematically illustrates a control system 600 for a micro AFD 100 in accordance with an embodiment of the present disclosure. The control system 600 electrically interconnects an actuator/blocking device 620, e.g., the actuator/blocking devices 220 or 520, an initiator 630, e.g., the electrical resistance heater 1020 for the first pyrotechnic 1030, and a status indicator 640 configured to provide an indication of whether the micro AFD is in either the SAFE arrangement or the FIRE arrangement.

Embodiments of micro AFDs according to the present disclosure can provide a number of advantages, including complying with the requirements of MIL-STD-1901 within the space of a conventional initiator, e.g., about the size of a small spool of thread or Micro AFDs according to the present disclosure can also withstand all environments experienced by a missile, shock, vibration, temperature extremes, etc.

C. Alternative Embodiments or Features

From the foregoing, it will be appreciated that specific embodiments of the disclosure have been described herein for purposes of illustration, but that various modifications can be made without deviating from the spirit and scope of the disclosure. For example, the AFDs and related concepts presented in this disclosure can be used in applications other than those discussed above. For instance, some techniques used in the disclosed AFDs can be used in oil field applications. Additional features such as an additional alignment hole that is moveable in response to over-temperature conditions can also be included. Moreover, specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the invention. Accordingly, embodiments of the disclosure are not limited except as by the appended claims.

We claim:

1. An ARM-FIRE device for a pyrotechnic system, comprising:

a first pyrotechnic;

a second pyrotechnic configured to be ignited by the first pyrotechnic; and a shutter mechanism disposed between the first and second pyrotechnics to selectively block the flow of ignited pyrotechnics, the shutter mechanism including:

a base, a body linearly slidable with respect to the base in moving from a first position to a second position, the first position interrupting an ignition train from the first pyrotechnic to the second pyrotechnic, the second position of the body permitting access of the ignition train from the first pyrotechnic to the second pyrotechnic; and the base includes a first hole defining a slot and the body comprises a sled having a protrusion slidably received in the slot of the base.

2. The device of claim 1 wherein the first pyrotechnic, the second pyrotechnic, and the shutter mechanism occupy a volume of approximately 3 cubic inches or less.

3. The device of claim 1 wherein the actuator comprises a shaped metal alloy wire actuator.

4. The device of claim 1, wherein the base includes a first hole and the body includes a second hole, the first hole being offset from second hole in the first position, the first hole being aligned with the second hole in the second position.

5. The device of claim 1 wherein the shutter mechanism further includes a cover coupled to the base, and the body positioned between the base and the cover.

6. The device of claim 5 wherein the body includes an aperture and the cover comprises an opening to be aligned with the aperture in the second position of the body.

7. The device of claim 1 wherein the shutter mechanism further includes a spring configured to bias the body toward the first position.

8. The device of claim 1 wherein the shutter mechanism further includes a latch configured to hold the body in the second position.

9. The device of claim 1, further comprising a cover coupled to the base, the cover having a first hole, the sled being disposed between the base and the cover, the sled includes a second hole with the first hole being offset from second hole in the first position, the first hole being aligned with the second hole in the second position.

10. The device of claim 9, wherein the actuator comprises a shaped metal alloy wire wrapped about the periphery of the sled, the wire contracting in response to an electric current to move the sled within the slot from the first position to the second position the wire elongating upon removal of the electric current to permit the sled to return from the second position to the first position, the shutter mechanism further including a return spring engaged with the protrusion of the sled to bias the sled back to the first position.

11. The device of claim 1, further comprising a membrane located between the shutter mechanism and the second pyrotechnic to separate the second pyrotechnic from the shutter mechanism to prevent the second pyrotechnic material from entering the shutter mechanism prior to ignition.

12. An ARM-FIRE device for a pyrotechnic system, comprising:

a first pyrotechnic;

a second pyrotechnic configured to be ignited by the first pyrotechnic; and a shutter mechanism between the first pyrotechnic and the second pyrotechnic, the shutter mechanism including a first hole and a second hole, the second hole being configured to move between a first position offset from the first hole and a second position aligned with the first hole, the shutter mechanism comprising:

a base including the first hole defining a slot, and a body configured to move relative to the base, the body including the second hole and a protrusion received in the slot.

13. The device of claim 12, further comprising a cover including a third hole for alignment with the second hole.

14. The device of claim 12 wherein the shutter mechanism includes an actuator configured to move the body relative to the base.

15. The device of claim 14 wherein the actuator comprises a shaped metal alloy wire actuator.

16. A pyrotechnic system comprising:

a pyrotechnic charge; and an initiator including a first pyrotechnic and a second pyrotechnic to define an ignition train between the initiator and the pyrotechnic charge; and a shutter mechanism disposed between the first and second pyrotechnics to interrupt the ignition train the shutter mechanism including:

a base including a first hole;

a body including a second hole, the body being linearly slidable with respect to the base in moving from a first position to a second position, the first and second holes being offset from one another in the first position to interrupt the ignition train from the first pyrotechnic to the second pyrotechnic, the first and second holes being aligned with one another in the second position of the body to permit access of the ignition train from the first pyrotechnic to the second pyrotechnic; and an actuator configured to move the body from the first position to the second position; and the first hole of the base defines a slot and the body comprises a sled having a protrusion slidably received in the slot of the base.

17. The system of claim 16, further comprising a return spring to bias the body in the first position.

18. A method of selectively interrupting an ignition train in a pyrotechnic system between a first pyrotechnic and a second pyrotechnic, the method comprising:

controlling an actuator to linearly slide a body having a first hole with respect to a base having a second hole from a first position in which the first and second holes are offset to a second position in which the first and second holes are aligned, the second hole of the base defines a slot and the body comprises a sled having a protrusion slidably received in the slot of the base.

19. The method of claim 18, further comprising biasing the body to return to the first position.

* * * * *

UNITED STATES PATENT AND TRADEMARK OFFICE

CERTIFICATE OF CORRECTION

PATENT NO. : 9,285,198 B2
APPLICATION NO. : 12/370582
DATED : March 15, 2016
INVENTOR(S) : Steven D. Nelson et al.

It is certified that error appears in the above-identified patent and that said Letters Patent is hereby corrected as shown below:

IN THE SPECIFICATION

Column 2, line 7, delete "3.0 (cubic inches)" and insert --(3.0 cubic inches)--

Column 4, line 56, delete "Gaivanoformung" and insert --Galvanoformung--

Signed and Sealed this
Thirty-first Day of May, 2016

Michelle K. Lee

Michelle K. Lee
*Director of the United States Patent and Trademark Office*